US005363123A

United States Patent [19]

Petersen et al.

[11] Patent Number: 5,363,123

[45] Date of Patent: Nov. 8, 1994

[54] CUTTER DRIVE FOR A COMPUTER DRIVEN PRINTER/PLOTTER

[75] Inventors: David Petersen, Poway; Jorge Pont, Encinitas, both of Calif.

[73] Assignee: Hewlett-Packard Company, Palo Alto, Calif.

[21] Appl. No.: 913,268

[22] Filed: Jul. 14, 1992

[51] Int. Cl.[5] ..... B41J 11/70

[52] U.S. Cl. ..... 346/24; 400/621

[58] Field of Search ..... 346/24; 400/621, 353; 83/485, 614

[56] References Cited

U.S. PATENT DOCUMENTS 3,199,109 8/1965 Battaglini et al. ..... 346/24
3,951,252 4/1976 Selke et al. ..... 197/133 A
4,525,088 6/1985 Shipos et al. ..... 400/621
4,701,063 10/1987 Wysk et al. ..... 400/621

FOREIGN PATENT DOCUMENTS 1416714 12/1975 United Kingdom .

*Primary Examiner*—Benjamin R. Fuller
*Assistant Examiner*—N. Le

[57] ABSTRACT

A cutter drive for a computer driven printer/plotter employs a cutter carriage which is separate from the printer carriage and which is attachable to and detachable from the printer carriage to be moved thereby without a separate cutter drive. Camming surfaces on a pickup arm and a pickup hook permit the cutter carriage to be mechanically engaged and disengaged from the printer carriage without any motors or magnets.

9 Claims, 7 Drawing Sheets

CUTTER DRIVE FOR A COMPUTER DRIVEN PRINTER/PLOTTER

BACKGROUND OF THE INVENTION

The present invention pertains to the field of computer driven printer/plotters particularly designed for producing engineering or other large drawings on paper, vellum, film or other printing media which is drawn through the mechanism from a roll thereof. Typically, the media may have a width from 8 ½ inches to as much as 3 or 4 feet or more.

With reference to a rectangular coordinate system, the paper or other printing medium is drawn through the printer in the X direction and a thermal inkjet printer carriage is mounted for movement transversely of the paper in what shall be referred to as the Y direction. A sheet of paper or other printing medium is either manually fed or paper is drawn from a supply roll thereof around a platen roller which may or may not be power driven.

Prior art cutter drive arrangements include drive of the cutter carriage back and forth across its path of movement by its own separate drive or the cutter carriage it may De coupled to the printer carriage when cutting is to take place. One such arrangement which involves electromechanical coupling of the cutter carriage to the printer carriage is shown in Pat No. 3,951,252 issued Apr. 20, 1976 to Selke.

Another arrangement which uses electromechanical coupling is disclosed in co-pending U.S. application Ser. No. 07/879,628, filed May 7, 1992 by inventor Ventura Caamano and assigned to the assignee of the present invention.

It is an object of the present invention to provide a means for coupling a cutter carriage to and de-coupling a cutter carriage from a printer carriage without the use of electromechanical coupling.

Accordingly, the present invention provides a cutter drive for a computer driven printer/plotter comprising:

a) a motor driven printer carriage (20) which is linearly moveable transversely across the path of travel of a roll of print media to be cut, and b) a cutter carriage (40) which is linearly moveable from a parked position transversely across and back across the path of travel of said media to be cut to return to said parked position, said cutter carriage comprising:

1) a support bracket (42), said support bracket having means (46; 50–53) thereon for supporting said carriage for said transverse movement; and 2) a cutter blade (60) rotatably mounted on said support bracket;

a first one of said carriages having a carriage pickup hook (25) affixed thereto, said pickup hook having an inclined upper ramp (26), an inclined lower ramp (27) spaced from said upper ramp in the direction of travel of said first carriage, a pusher surface (32) and a shelf (28) defining a support platform (29) and a lower surface (30); and a second one of said carriages having a pickup arm (80) affixed thereto in the path of travel of said pickup hook for engagement therewith, said pickup arm having an inclined ramp and first and second edges (87, 88) respectively engageable with said first carriage and said pusher surface, said pickup arm being moveable in a first direction from a free position by said inclined upper ramp (26) as said first carriage moves in a first direction toward said second carriage in its parked position, said pickup arm moving to be supported on said platform (29) as said second edge (88) passes the upper end of said upper ramp (26) whereby said pusher surface (32) on said pickup hook engages said second edge (88) on said pickup arm to permit said first carriage to move said second carriage across said transverse path in a second direction, said pickup hook shelf being moved from its position supporting said pickup arm as said first carriage reaches the opposite end of its path of travel and reverses direction to again move in said first direction thereby permitting said pickup arm to return to its free position, said first carriage engaging said first edge (87) of said pickup arm as said first carriage moves in said first direction until said second carriage reaches its parked position and said first carriage again reverses to move in said second direction whereby said lower ramp (27) of said pickup hook engages said inclined ramp (84) of said pickup arm moving it in a second direction away from its free position, said lower surface (30) of said shelf slideably engaging said pickup arm until said first carriage moves away from said parked second carriage and said pickup arm returns to its free position.

DETAILED DESCRIPTION

Figure 1:
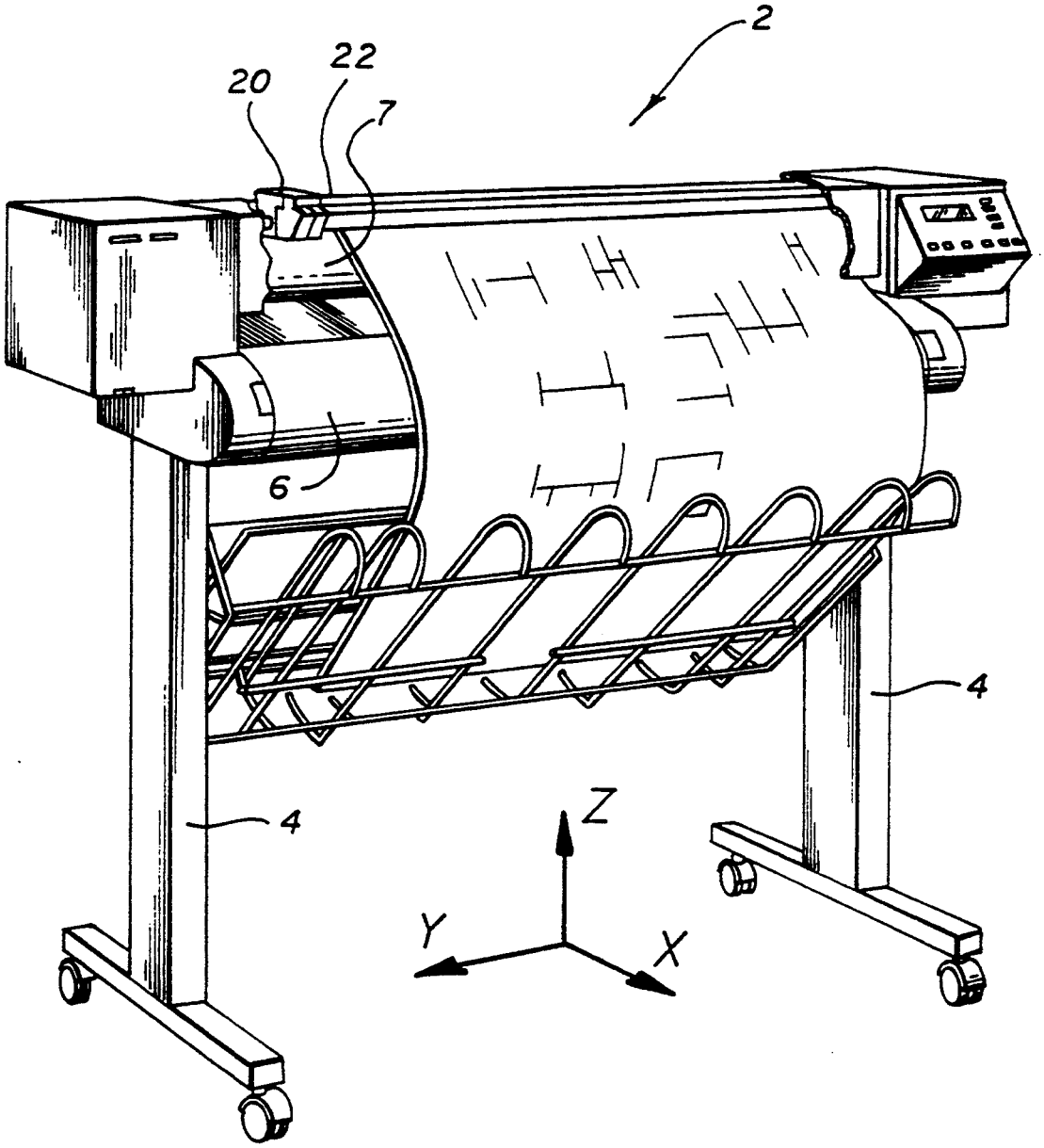
FIG. 1 is a perspective view of a printer/plotter mechanism showing the cover partly broken away to reveal a platen roller, a print head carriage mounted on slider rods which extend parallel to the axis of the platen roller and a cutter carriage.

FIG. 1 is a perspective view of a printer/plotter mechanism having a chassis 2 supported by a pair of spaced legs 4 and a housing which includes a generally arcuate cover 6 for containing a roll of print medium such as paper, vellum or film. As seen in the broken away section at the top of FIG. 1, a platen roller 7 extends transversely of the apparatus in the Y direction to provide a support and printing path at its upper surface for the medium upon which printing is to take place. A pair of slider rods 12, 13 (FIG. 2) support a transversely movable printer carriage 20 having one or more print heads 22 (seen in FIG. 1) mounted thereon which are positioned a precise distance above the platen roller 10.

Figure 2:
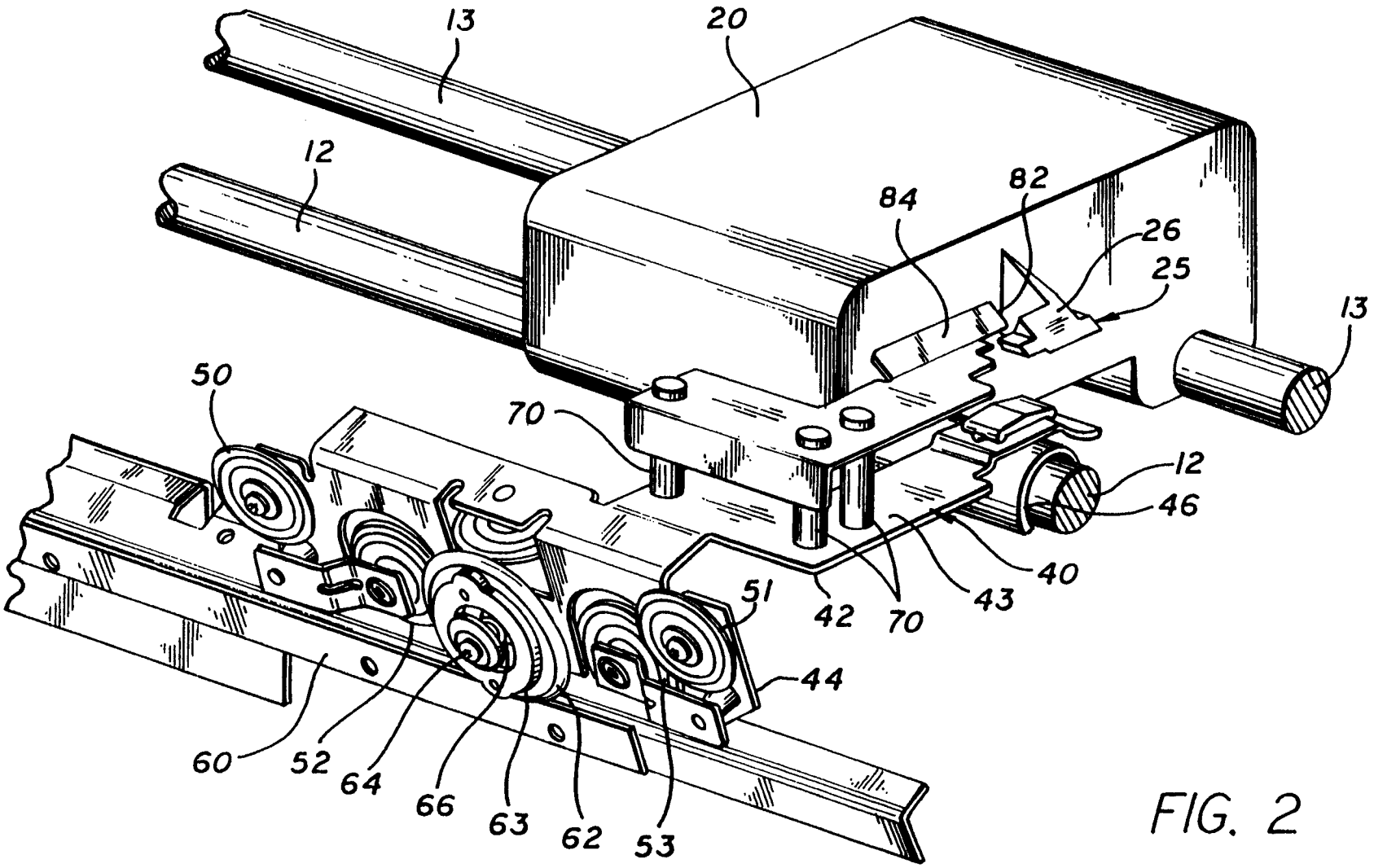
FIG. 2 is an enlarged perspective view of the printer carriage and the cutter carriage.
Figure 3:
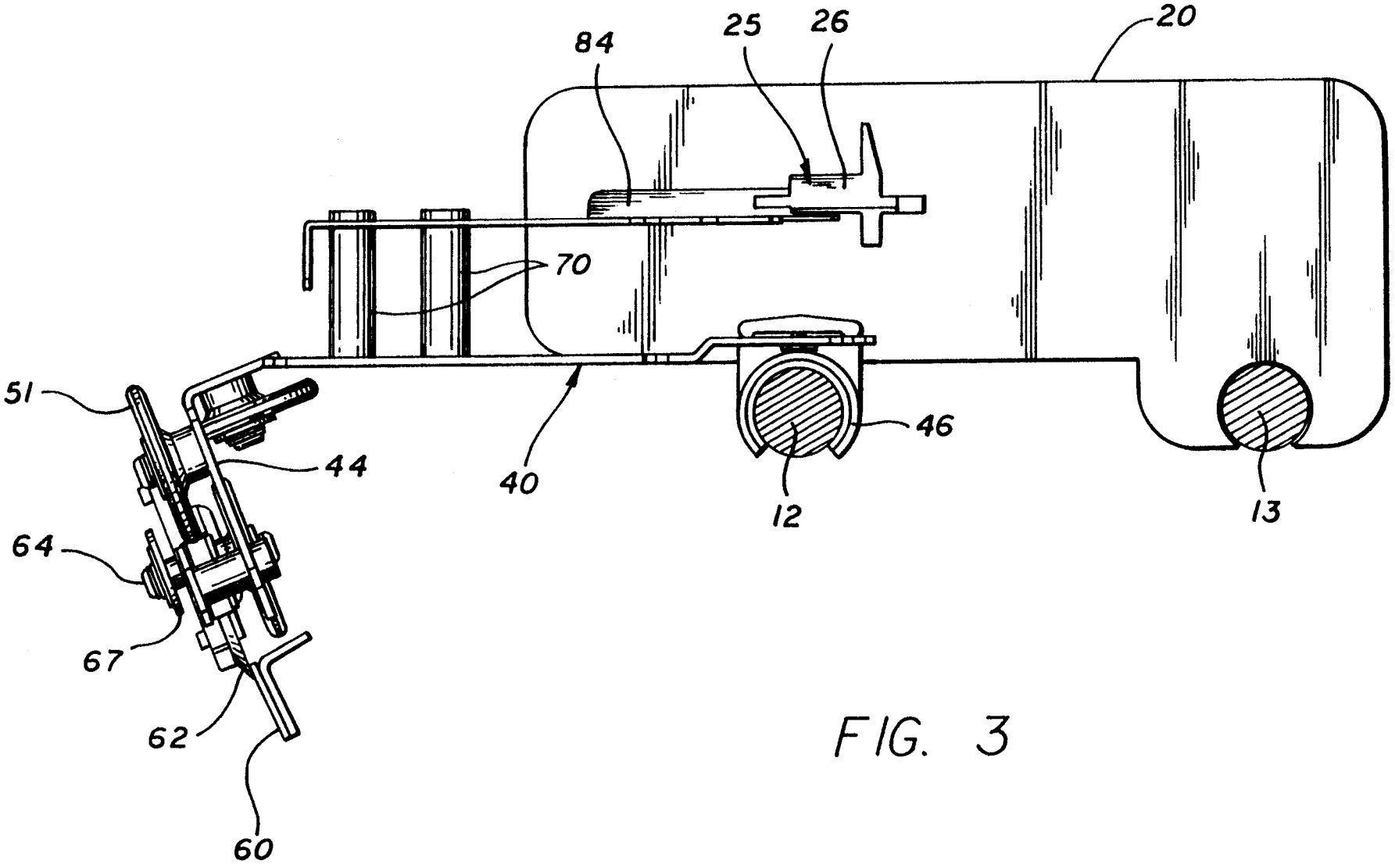
FIG. 3 is a right side elevation view of the printer carriage and cutter carriage as seen in FIG. 2.
Figure 4:
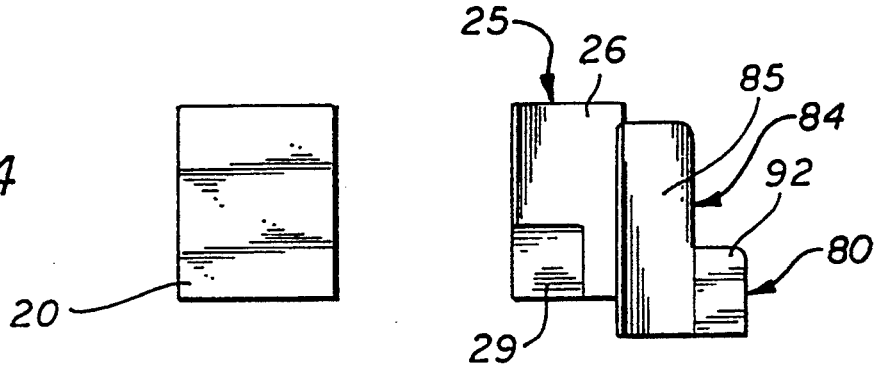
FIGS. 4 through 19 respectively comprise a series of top and front elevation schematic views of the printer carriage pickup hook and the cutter carriage pickup arm engagement and disengagement steps.

The general construction of the printer carriage 20 forms no part of the present invention; however, as best seen in FIGS. 2, 3 and 4, the invention involves a pickup hook 25 which, in the illustrated embodiment, is affixed to the printer carriage, the pickup hook having an inclined upper ramp 26 and an inclined lower ramp 27 parallel to the upper ramp 26 but spaced therefrom in the direction of travel of the carriage 20 (the Y direction) and a vertically extending pusher surface 32 (FIG. 5) for purposes to be described. The ramps are separated by a shelf 28 which extends generally horizontally (in the X–Y plane). The shelf has an upper surface or support platform 29 and a lower surface 30 . The pickup hook 25 may be constructed of Teflon (Trademark) or other known lubricous material.

The cutter carriage 40 is seen in FIGS. 2 and 3 to comprise a bent sheet metal bracket 42 having a generally horizontally extending flange 43 and a generally vertically extending flange 44. The remote edge 45 of the horizontal flange as seen in FIG. 3 is slideably supported on guide rod 12 by an arcuate slide bearing 46. The generally vertically extending flange 44 of the bracket has a plurality of guide and support wheels 50–53 rotatably mounted thereon in suitable bearings as shown. The two lower wheels 52, 53 ride upon a rigid angle track 55 which comprises part of the printer/plotter chassis and the two upper wheels 50, 51 are guided in a guideway (not shown) which is also part of the chassis. A linear cutter blade 60 is affixed to the generally vertically extending side of the angle track 55 and has its upper cutting edge extending slightly thereabove. A cutter wheel 62 replaceably attached to a support flange 63 is rotatably mounted on an axle 64 supported on the bracket 40 and is biased into engagement with the blade 60 by a compression spring 66 which acts between the wheel 62 and a nut and washer 67 affixed to the axle.

Figure 5:
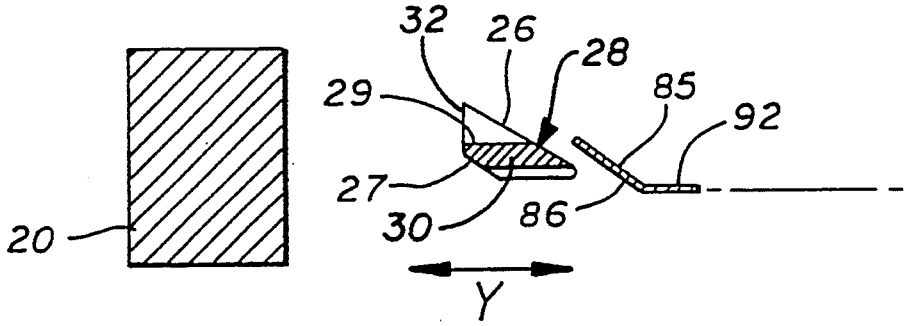
Figure 10:
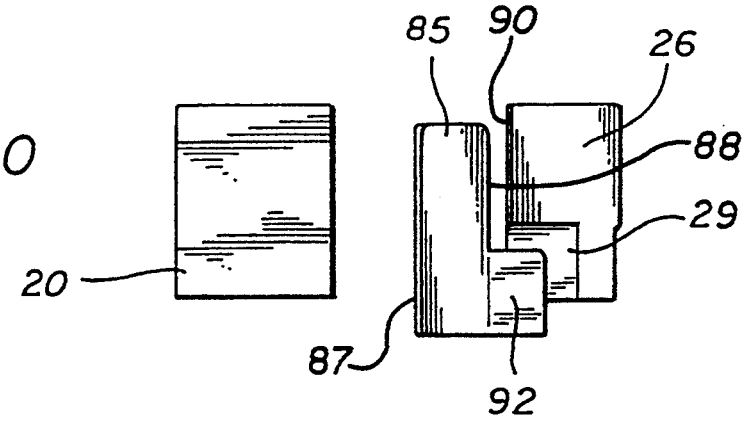

A plurality of posts 70 extending above the horizontal flange 43 of the bracket 42 support a cutter pickup arm 80 thereon a selected distance from the flange 43 to permit substantially unrestrained vertical movement of the pickup arm above and below its free position as indicated in FIG. 5. The pickup arm 80 is made of a thin sheet metal having sufficient flexibility or is mounted on the posts 70 with sufficient compliance in the vertical direction to permit at least its remote end 82 to be vertically moved upon engagement with the pickup hook ramps 26, 27 previously described. The pickup arm 80 has an inclined ramp 84 which has upper and lower camming surfaces 85, 86 thereon (FIG. 5) and first and second edges 87, 88 (FIG. 10) respectively engageable with vertically extending pusher surfaces 89, 90 on the printer carriage and pickup hook. Pickup arm 80 also has a support flange 92 for resting on platform 29 on the pickup hook. It will be appreciated that the exact configuration of the pickup arm may be varied somewhat from the configuration shown to, e.g., a round pin which is essentially the same functional equivalent. The term "ramp" accordingly include functionally equivalent shapes such as oval and circular pins.

Figure 6:
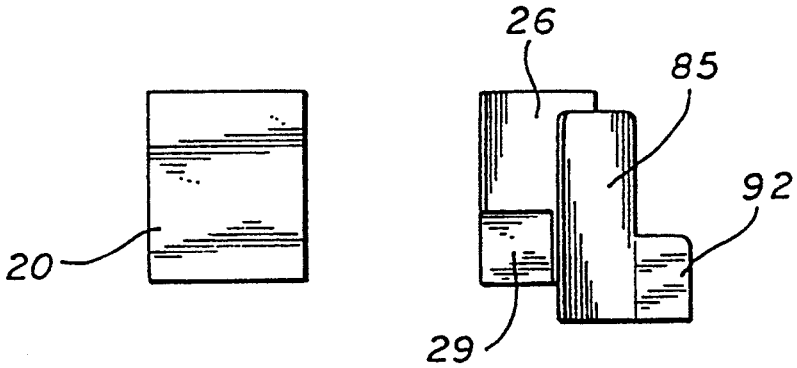
Figure 7:
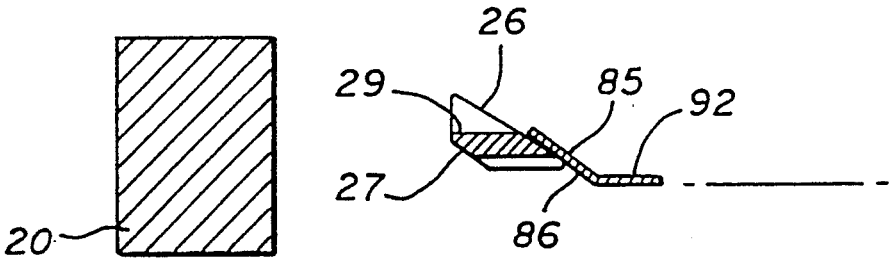
Figure 8:
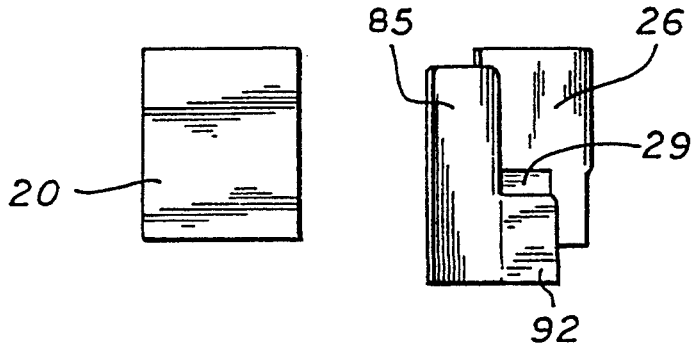
Figure 9:
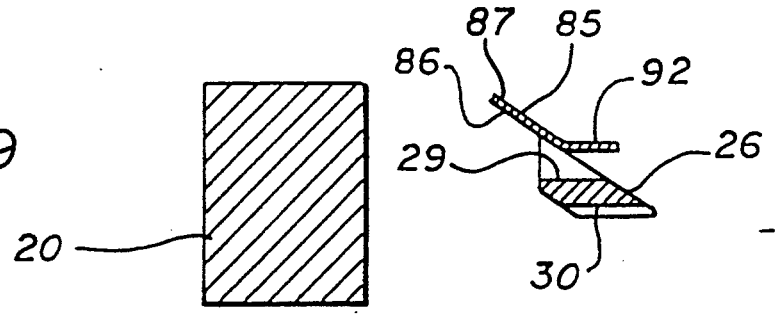
Figure 11:
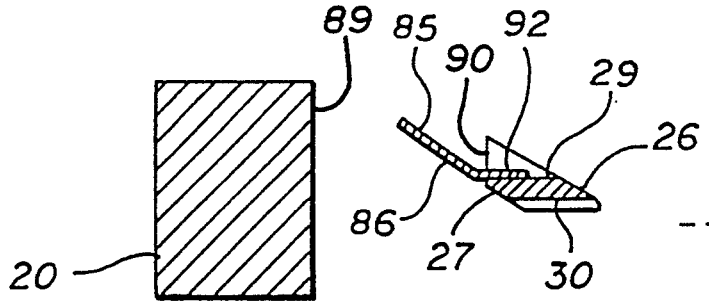
Figure 12:
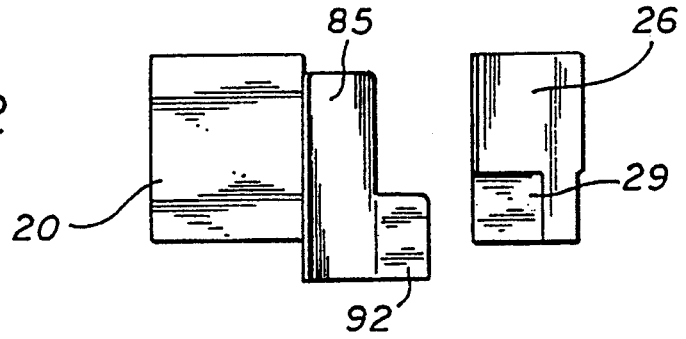
Figure 13:
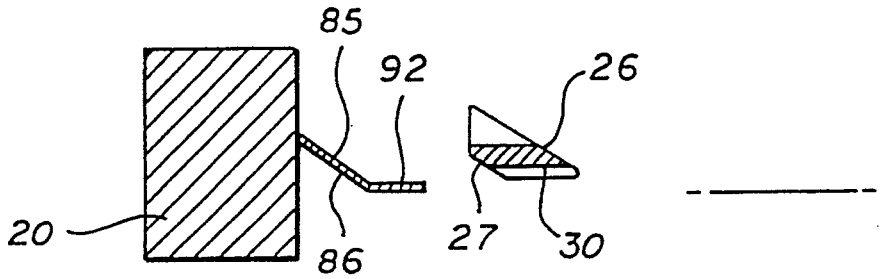
Figure 14:
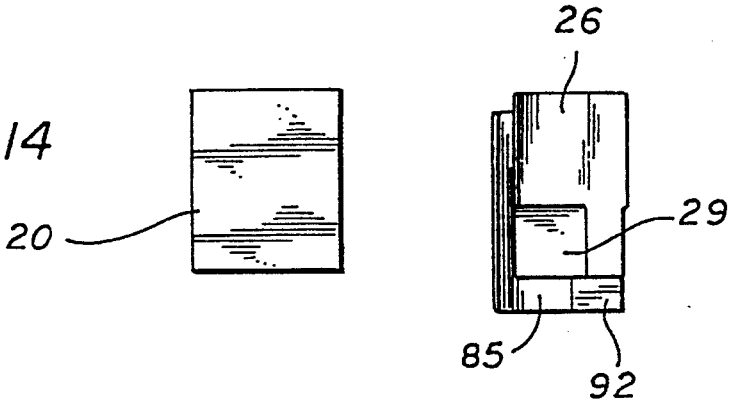
Figure 15:
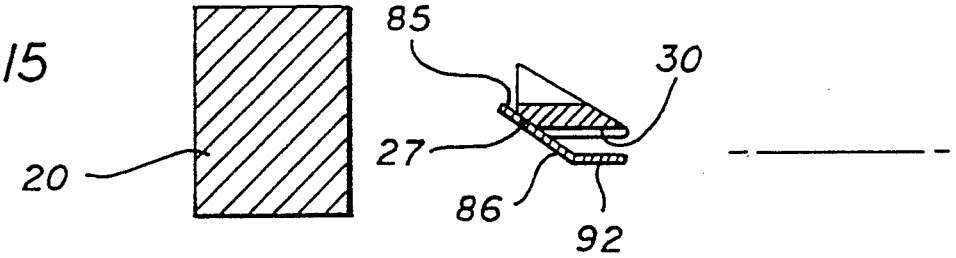
Figure 16:
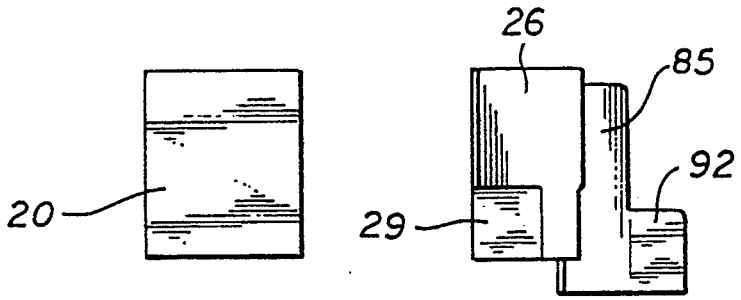
Figure 17:
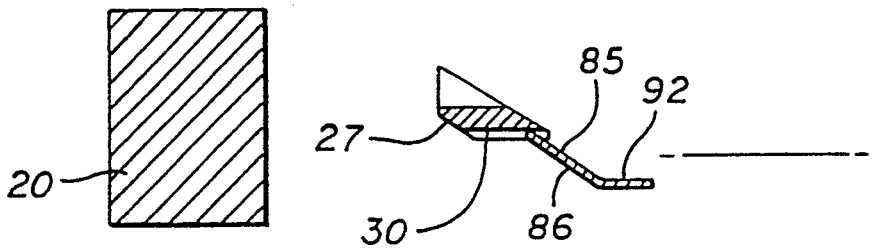
Figure 18:
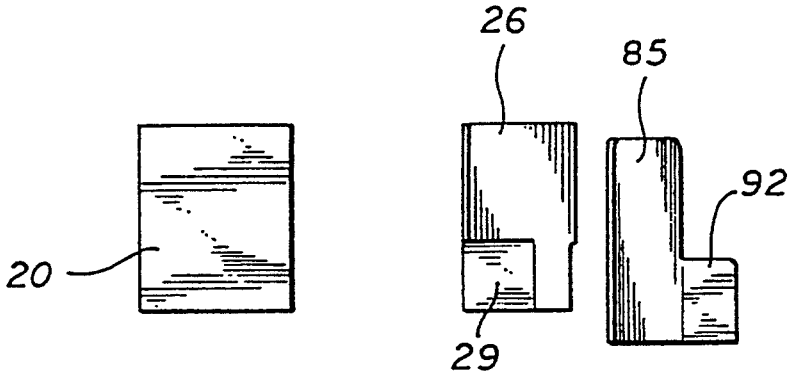
Figure 19:
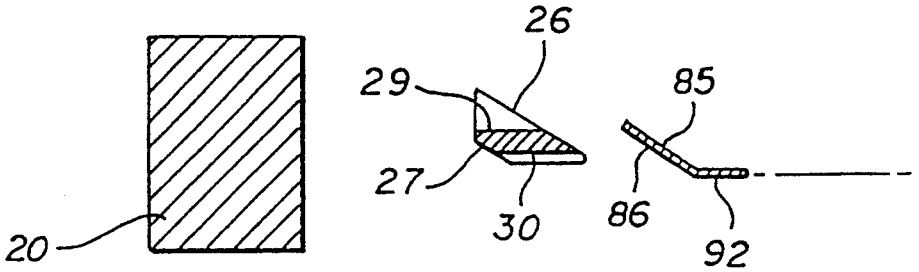

FIGS. 4 through 19 respectively show top and front views of the cutter carriage 40 in a parked or inoperative position at the right end of its travel on the chassis (FIGS. 4 and 5; the initial stage of engagement of the printer carriage 20 as it moves to the right to pick up the cutter carriage (FIGS. 6 and 7); the connecting position of the pickup hook 25 relative to the pickup arm 80 as the pickup arm rides up the pickup hook surface 26 (FIGS. 8 and 9); the connected position of the pickup arm flange 92 resting on the pickup hook platform 29 as the printer carriage reverses direction moves to the left pulling the cutter carriage therewith (FIGS. 10 and 11); the disengagement of the pickup arm from the pickup hook as the pickup arm drops to its free height at the opposite or left end of the path of travel of the printer and cutter carriages (FIGS. 12 and 13); the initial (FIGS. 14 and 15) and final (FIGS. 16 and 17) disconnecting position of the pickup arm as the pickup hook lower ramp 27 pushes it downwardly when the cutter carriage has reached the right end storage position and the print carriage is retreating to the left; and the disconnected relationship like FIGS. 4 and 5 (FIGS. 18 and 19).

Although the presently preferred embodiment of the invention has been described in detail, modifications thereto may be apparent to persons skilled in the art. For example, the locations of the pickup arm and the pickup hook may be reversed, i.e., the pickup hook may be located on the cutter carriage instead of on the printer carriage and the pickup arm may be located on the printer carriage instead of the cutter carriage. It is therefore intended that the scope of protection be defined only by the limitations of the appended claims.

We claim:

1. A cutter drive for a computer driven printer/plotter comprising:

a) a motor driven printer carriage which is linearly moveable between a first end position and a second end position in a path of travel which extends transversely across a path of travel of a roll of print media to be cut, and b) a cutter carriage which is linearly moveable between a first end parked position and a second end position in a path of travel transversely across and back across said path of travel of said media to be cut to return to said parked position, said cutter carriage comprising:

1) a support bracket, said support bracket having support means thereon for supporting said cutter carriage for said transverse movement; and 2) a cutter blade rotatably mounted on said support bracket; a first one of said carriages having a carriage pickup hook affixed thereto, said pickup hook having an inclined upper ramp, an inclined lower ramp spaced from said upper ramp in said path of travel of said first one of said carriages, a pusher surface and a shelf defining a support platform and a lower surface; and a second one of said carriages having a pickup arm affixed thereto in the path of travel of said pickup hook for engagement with said pickup hook, said pickup arm having an inclined ramp and first and second edges respectively engageable with said first one of said carriages and said pusher surface, said pickup arm being lifted from a free position disengaged from said pickup hook by said inclined upper ramp as said first one of said carriages moves in a first direction toward said second one of said carriages, said pickup arm moving to be supported on said platform as said second edge passes an upper end of said upper ramp whereby said pusher surface on said pickup hook engages said second edge on said pickup arm to permit said first one of said carriages to move said second one of said carriages across said transverse path, said pickup hook shelf being moved from a position in which said shelf supports said pickup arm as said first one of said carriages reaches said second end position and reverses direction to again move in said first direction thereby permitting said pickup arm to return to said free position, said first one of said carriages engaging said first edge of said pickup arm as said first one of said carriages moves in said first direction until said second one of said carriages reaches said first end parked position and said first one of said carriages again reverses to move in a second direction whereby said lower ramp of said pickup hook engages said inclined ramp of said pickup arm moving said pickup arm away from said free position, said lower surface of said shelf slideably engaging said pickup arm until said first one of said carriages moves away from said second carriage and said pickup arm returns to said free position.

2. A cutter drive according to claim 1, wherein said support means comprises a combination of rollers and a slide support.

3. A cutter drive according to claim 2, wherein said pickup hook is made of lubricous material.

4. A cutter drive according to claim 1, wherein said first one of said carriages pulls said second one of Said carriages in said second direction and pushes said second one of said carriage in said first direction.

5. A cutter drive according to claim 1, wherein said upper ramp of said pickup hook moves said pickup arm upwardly during connection as said first one of said carriages moves in said first direction while said second one of said carriages is in a parked position.

6. A cutter drive according to claim 5, wherein said pickup arm drops to and is supported by said shelf at an elevation above said free position as said connection is completed prior to movement of connected printer and cutter carriages in said second direction.

7. A cutter drive according to claim 6, wherein said pickup arm is lowered by inherent compliance to said free position as said first one of said carriages moves in said first direction toward said second one of said carriages at the end of the path of travel of said second one of said carriages remote from said parked position of said first one of said carriages.

8. A cutter drive according to claim 7, wherein said lower ramp of said pickup hook moves said pickup arm downwardly from said its free position as said first one of said carriages moves in said second direction during disconnection without movement of said second one of said carriages in said second direction.

9. A cutter drive according to any one of the preceding claims wherein said first one of said carriages is said printer carriage and said second one of said carriages is said cutter carriage, and said pickup arm is affixed to said support bracket.

* * * * *